US005803505A

United States Patent [19]

Schwan et al.

[11] Patent Number: 5,803,505

[45] Date of Patent: Sep. 8, 1998

[54] BUSINESS RECORD HAVING A MULTICOLOR IMAGABLE SURFACE

[75] Inventors: Joseph V. Schwan, Kettering; Mark D. Dotson, Dayton, both of Ohio

[73] Assignee: The Standard Register Company, Dayton, Ohio

[21] Appl. No.: 619,454

[22] Filed: Mar. 18, 1996

Related U.S. Application Data

[63] Continuation of Ser. No. 312,424, Sep. 26, 1994, Pat. No. 5,524,934, which is a continuation of Ser. No. 55,576, May 3, 1993, abandoned.

[51] Int. Cl.[6] ..... B42D 15/00

[52] U.S. Cl. ..... 283/95

[58] Field of Search ..... 283/61, 91, 95, 283/901; 503/201, 204, 206; 427/146, 152; 428/194

[56] References Cited

U.S. PATENT DOCUMENTS

| | | | |
|---|---|---|---|
| 3,565,005 | 2/1971 | Knott | 503/204 X |
| 4,577,205 | 3/1986 | Shibata et al. . | |
| 4,627,641 | 12/1986 | Kawaguchi . | |
| 5,344,191 | 9/1994 | Chang . | |
| 5,462,909 | 10/1995 | Lakes et al. | 503/204 X |
| 5,618,063 | 4/1997 | Chang et al. . | |

FOREIGN PATENT DOCUMENTS

| | | |
|---|---|---|
| 297705 | 1/1989 | European Pat. Off. . |
| 3925088 | 1/1991 | Germany . |
| 2163562 | 2/1986 | United Kingdom . |
| 8906191 | 7/1989 | WIPO . |

*Primary Examiner*—Willmon Fridie, Jr.
*Attorney, Agent, or Firm*—Killworth, Gottman, Hagan & Schaeff, L.L.P.

[57] ABSTRACT

A business record such as a form, tag, label or the like is provided in which different selected colored areas may be activated in a single pass through a printer. In one embodiment, coatings of initially colorless color formers and color developers are coated on selected areas of a substrate surface. The color formers and color developers combine upon exposure to an imaging force, such as heat or pressure, to form different colored visible areas on the sheet. In an alternative embodiment, the coatings of color formers and color developers are self-contained coatings having pressure-rupturable microcapsules containing either the color formers or said color developers.

2 Claims, 4 Drawing Sheets

BUSINESS RECORD HAVING A MULTICOLOR IMAGABLE SURFACE

This is a continuation of application Ser. No. 08/312,424, filed Sep. 26, 1994 now U.S. Pat. No. 5,524,934, which is a continuation of application Ser. No. 08/055,576, filed May 3, 1993, now abandoned.

BACKGROUND OF THE INVENTION

This invention relates to a business record, such as a form, label, tag, or the like, in which different selected areas may be color activated. More particularly, the invention relates to a sheet containing on its surface coatings of selected initially colorless color formers and color developers which, when subjected to heat or pressure, combine to form different colored areas on the sheet.

In the design and use of business forms, labels, tags, and the like, it is desirable to present information in an organized fashion so that information may be readily assimilated. For example, forms typically use headings or columns to identify different categories of information. Lines, rules, and screened areas are also used to delineate specific areas of information.

Color has also been used on business forms to delineate or differentiate information. For example, multipart forms, with each part being printed on different colored paper, have been in use for many years. The different color of each part of the form designates to whom that part is to be given or sent. Others have used different colored forms, labels, or tags to designate, for example, different methods of shipment of packages. As with multi-part forms, however, this method of designation requires that the user maintain an inventory of each different colored form, label, or tag.

To better differentiate categories of information, preprinted screened background areas are often printed in selected colors. One known method used for producing different colors is to apply colored inks during the printing process when the forms are being manufactured. However, such a process requires a separate printing station for each color of ink used. In addition, if the techniques of process color are used, different shades or hues of color can only be produced by printing two or more colors in a superimposed relationship onto selected areas of the form.

In the field of product labeling, direct thermal printing has been a well-known means of non-impact printing. Direct thermal printers are capable of forming colored images by the application of heat to a substrate containing heat-reactive chemicals thereon. Typically, a substrate such as paper is coated with a coating of color forming and color developing reactants which, when heated, combine to form a visible color. When such a coated substrate passes under the print head of a thermal printer, selected areas containing the coating are activated by the heated print elements, forming colored images on the surface of the substrate.

Another method of printing colored images is by applying heat at different temperatures or by applying different quantities of thermal energy to a coated substrate. For example, U.S. Pat. No. 4,665,410 to Iiyama et al teach a multi-color thermosensitive recording material formed by applying three or more successively overlaid thermosensitive coloring layers to a support material with intervening decolorizing agent containing layers. Each coloring layer yields a different color depending on the quantity of thermal energy applied. However, such coatings must be applied separately. Also, it is believed that separate printing passes are needed to activate selected colors.

It is also possible to achieve colored images from the use of self-contained carbonless coatings which produce colored images upon the application of pressure such as that from an impact printer. Such coatings are well known, and typically contain dispersed color developers and initially colorless leuco dyes contained in solution within microcapsules.

However, these methods do not presently provide a means for achieving different selected colored areas on a form, label, tag or the like by printing in a single pass. Accordingly, there still exists a need in the art for a business form, label, or the like having selected areas which produce selected colored areas when printed in a single pass through a direct thermal printer or an impact printing device.

SUMMARY OF THE INVENTION

The present invention meets that need by providing a business record such as a form, label, or tag having coatings of initially colorless color formers and color developers on selected areas which may be activated to produce a selected color or colors when imaged in a thermal printer or subjected to pressure or impact.

In accordance with one aspect of the invention, an imagable business record such as a form, label or tag is provided comprising a substrate such as a sheet having first and second surfaces. Preferably, the sheet includes on selected portions of the first surface means for forming areas of a plurality of different colors comprising coatings of initially colorless color formers and color developers. The color formers and color developers combine and form a colored area upon application of an imaging force. Such an imaging force may take the form of heat, pressure or a combination of heat and pressure.

In one embodiment, the color formers and color developers combine upon exposure to heat from a thermal print head to form colored visible areas including images, symbols, indicia, or the like on the sheet. Preferably, the color formers comprise initially colorless leuco dyes, while the color developers preferably comprise acidic phenolic compounds or resins. The color formers and developers are preferably contained in a binder matrix as separately dispersed particulate solids. Exposure of the coating to heat causes selected reactants to melt, permitting the color former and color developer to mix and react.

While it is possible to activate several areas so that multiple colors are formed on a document, it is also within the scope of the invention activate selected portions of the coated areas which produce only one color. The coatings may be applied to a form, label, tag or the like in a number of different patterns. For example, the coatings may be applied only around the peripheral edges of a sheet. In one preferred embodiment of the invention, the outer peripheral area of the sheet is coated with a color former and color developer which form a first color, a middle peripheral area adjacent the outer peripheral area is coated with a color developer and color former which form a second color, and the inner peripheral area adjacent the middle peripheral area is coated with a color former and color developer which form a third color. In another embodiment of the invention, the different coatings may be coated in an alternating side-by-side relationship about the periphery of the record. By activating selected areas, the periphery can be made to show a selected color.

In another embodiment of the invention, the sheet includes a plurality of columns, with each of the columns being coated with a color former and color developer which form a different selected color.

In a further embodiment of the invention, a business record such as a form, label, or tag is provided having selected areas which may be activated to produce color upon the application of pressure, such as an impact printing device. A sheet is provided having first and second major surfaces. The first surface of the sheet includes on selected portions thereof means for forming areas of at least a plurality of different colors comprising self-contained coatings of pressure-rupturable microcapsules containing either the color formers or color developers. Again, the preferred color formers are initially colorless leuco dyes, while the preferred color developers are acidic phenolic resins. The color formers and color developers are adapted to be combined upon the application of pressure to rupture the microcapsules and to form different colored visible areas.

In an alternative embodiment, the self-contained coatings may comprise solvent-soluble colored dye particles along with dispersed microcapsules containing a solvent for the dye particles. Such a self-contained coating is disclosed in U.S. Pat. No. 5,039,652, and is incorporated herein by reference. When pressure is applied to the sheet, the capsules rupture and react with the dye particles to form colored visible areas.

It is also possible in the embodiments using self-contained coatings to activate selected areas of the sheet so that only one color is produced. The self-contained coatings may be coated in a number of different patterns as described above.

In yet another embodiment of the invention, a continuous web for producing a series of imagable business forms, labels or tags is provided in which different selected colored areas may be activated. The continuous web preferably includes first and second major surfaces. The first surface of the web includes on selected portions thereof means for forming areas of at least a plurality of different colors comprising coatings of initially colorless color formers and color developers, which, when exposed to heat from a thermal printer, combine to form colored visible areas. Alternatively, the coatings may comprise self-contained coatings which combine to form colored visible areas upon impact or pressure comprising either pressure-rupturable microcapsules containing color formers or color developers, or self-contained coatings of solvent soluble dye particles and solvent-containing microcapsules.

Accordingly, it is a feature of the present invention to provide a business record such as a form, label, tag, or the like having on selected areas of its surface coatings of initially colorless color formers and color developers which, when exposed to an imaging force, combine to form different colored visible areas. Other features and advantages of the invention will be apparent from the following description, the accompanying drawings, and the appended claims.

DETAILED DESCRIPTION OF THE PREFERRED EMBODIMENT

Figure 1:
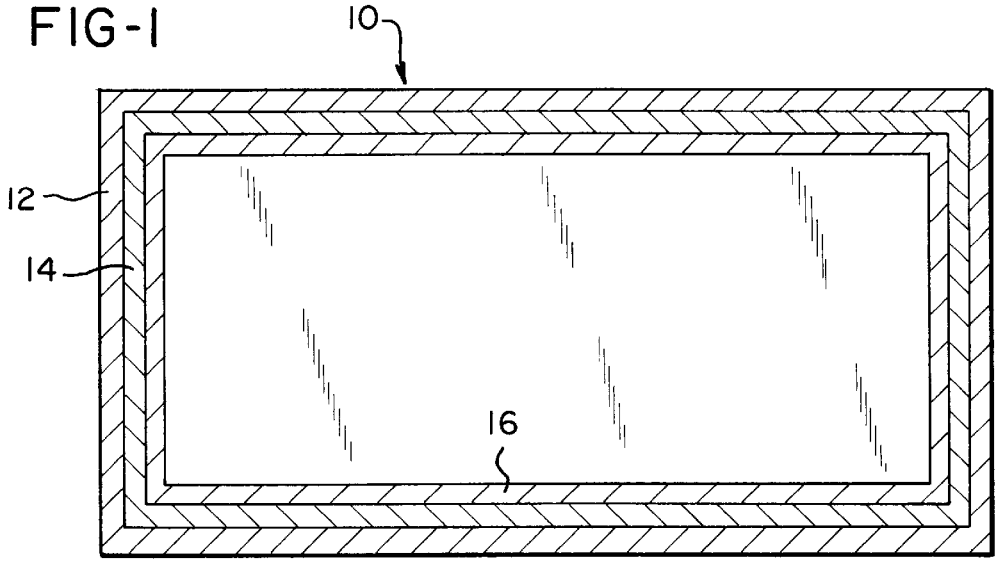
FIG. 1 is a plan view of a business form having selected activatable areas of color in accordance with the invention.

The coatings utilized in the present invention may be applied to any document or record including business forms, labels, tags, or other documents in which it is desirable to selectively designate colored areas. The document may be paper or other printable material.

Suitable color formers for use in the present invention include colorless chromogenic dye precursors known in the art such as triphenyl methanes, diphenyl methanes, leuco dyes, xanthene compounds, thiazene compounds, and spiropyran compounds such as those described in U.S. Pat. No. 5,102,856, incorporated herein by reference. Many different shades or hues of color may be produced on a document by combining color formers which form blue, yellow, green and red colors. Black images may also be produced by using a combination of color formers. Preferably, the color formers comprise from about 5 to 15% by weight of the coating formulation.

The color developers may be selected from acidic color developers known in the art such as zinc salicylate, acetylated phenolic resins, salicylic acid modified phenolic resins, zincated phenolic resins, novolac type phenolic resins, and other monomolecular phenols such as bisphenol A, 4,4'-isopropylidene diphenol, 4,4'-sulfonyl diphenol, p,p'(1-methyl-nhexylidene)diphenol, p-tert-butyl phenol, and p-phenyl phenol. The color developer is preferably present in the coating formulation from about 15 to 30% by weight.

In addition, the coating contains from about 40–70% by weight water, and from about 5 to 25% by weight of a sensitizer. Such sensitizers are low melting point solids which, when subjected to heat, melt and become solvents for the color forming and developing reactants. Suitable sensitizers include B-naphthol benzyl ether, p-benzyl biphenyl, ethylene glycol-m-tolyl ether, m-Terphenyl, Bis [2(4-methoxy) phenoxy] ether, and dibenzyl oxalate.

A binder is also included in the coatings to improve the rheological properties of the coating for better printability and to promote good adhesion of the coatings to the sheet surface. Suitable binders include starch, casein, polyvinyl alcohol, polyvinyl pyrrolidone, acrylamide/acrylate copolymers, carboxylated styrene butadiene latex, styrene acrylic latex, and mixtures thereof.

The coating formulation may also include from about 5 to 30% by weight of a pigment such as calcined clay, calcium carbonate, or plastic pigments.

Other optional ingredients include from about 5 to 25% by weight of a lubricant and from about 1 to 10% by weight of an anti-fading agent. Suitable lubricants include zinc stearate, stearamide, and wax. The anti-fading agent may comprise hindered phenols of the antioxidant class such as 1,1,3-tris(2-methyl-4-hydroxy-5-cyclohexylphenyl) butane.

The coatings are generally applied to the business record substrate by any suitable coating or printing process including flexographic or gravure printing techniques. The coatings may be applied in selected areas which can form blocks of background color, or they may be applied so as to form images, symbols, stripes, borders, and the like when passed through a thermal printer. Coatings which produce different colors are preferably coated or printed separately on each desired portion of the document. The coatings are preferably applied at a dry coating weight of between about 0.50 and 2.50 lbs/17"×22"×500 sheet ream, and may be selectively printed or coated on the surface of stock papers during the manufacturing process.

If desired, the color former and color developer coatings may be overcoated with a protective coating composition which provides the subsequently printed colored areas on the substrate with resistance to solvents, abrasion and fading from exposure to light. Such a composition is disclosed in Mehta, U.S. Pat. No. 4,999,334, and is incorporated herein by reference.

If the color formers and color developers are applied as self-contained coatings for imaging by mechanical force as by pressure or impact, the coatings are preferably applied at a dry coating weight of between about 0.30 and 3.00 lbs/17"×22"×500 sheet ream. In this embodiment, the color former-containing microcapsules may be produced by any method known in the art; however, a preferred method of microencapsulation is disclosed in Seitz, U.S. Pat. No. 4,889,877, the disclosure of which is incorporated by reference.

With reference to the drawings, it must be appreciated that Patent Office requirements for solid black line drawings on a white surface make illustration of some of the subtleties of our invention relating to different colors difficult by the required Patent Office drawings alone. Reference to the following detailed description of the illustration will make full appreciation of the drawings and our invention possible.

As can be seen in the drawing figures, the color former and color developer coatings may be printed on selected portions of a document in a number of patterns, depending on the desired application. It should be appreciated that many different combinations for placement of the coatings on a document are possible and are within the scope of this invention.

Referring now to FIG. 1, a business record 10 is shown comprising a sheet having first and second surfaces. The first surface of the sheet includes selected portions 12, 14, and 16 around the periphery of the record containing coatings of initially colorless color formers and color developers. The outer peripheral area 12 of the sheet is coated with a color former and color developer which form a first color, the middle peripheral area 14 adjacent the outer peripheral area is coated with a color developer and color former which form a second color, and the inner peripheral area 16 adjacent the middle peripheral area is coated with a color former and color developer which form a third color.

Figure 6:
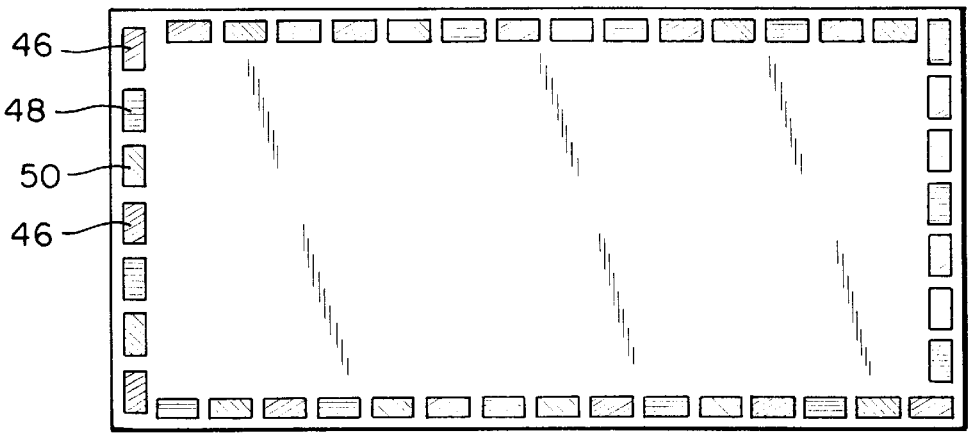
FIG. 6 is a plan view of a business form in accordance with another embodiment of the invention.

As shown in FIG. 6, the coatings may also be applied in alternating side-by-side relationship about the periphery of the record. For example, block 46 is coated with a color former and color developer which form a first color, block 48 is coated with a color former and color developer which form a second color, and block 50 is coated with a color former and color developer which form a third color. Such an arrangement allows one color to be selectively activated around the boundary of the form to provide an indication of how the form is to be processed.

Direct thermal printers currently in use in the art include print heads or print bars with small heated elements which are individually addressable by digital input from a controlling computer. When the record is passed under the print head or print bar of a thermal printer, selected heated elements are activated and heat selected areas on the record. The coating in the selected areas is heated, causing at least one component of the coating to melt and permit the color formers and color developers to combine to form a visible color. For example, portion 12 of the document may include a coating which produces a red color, portion 14 may include a coating which produces a blue color, and portion 16 may include a coating which produces a yellow color. The thermal printer can be programmed to activate all of the colors, or only selected colors. Both the colored areas and printed information on the record can be formed in a single printing pass. Thus, by selecting which colored area to activate, one can produce a color-coded document which imparts information to an end user. For example, the color of the document may be used as an indication of which department in an organization to which the document is to be routed. Additionally, the document may be in the form of a tag or label which is attached to an article or package, with the color providing an indication of method of shipment. The possible uses of the invention are many and varied.

Figure 2:
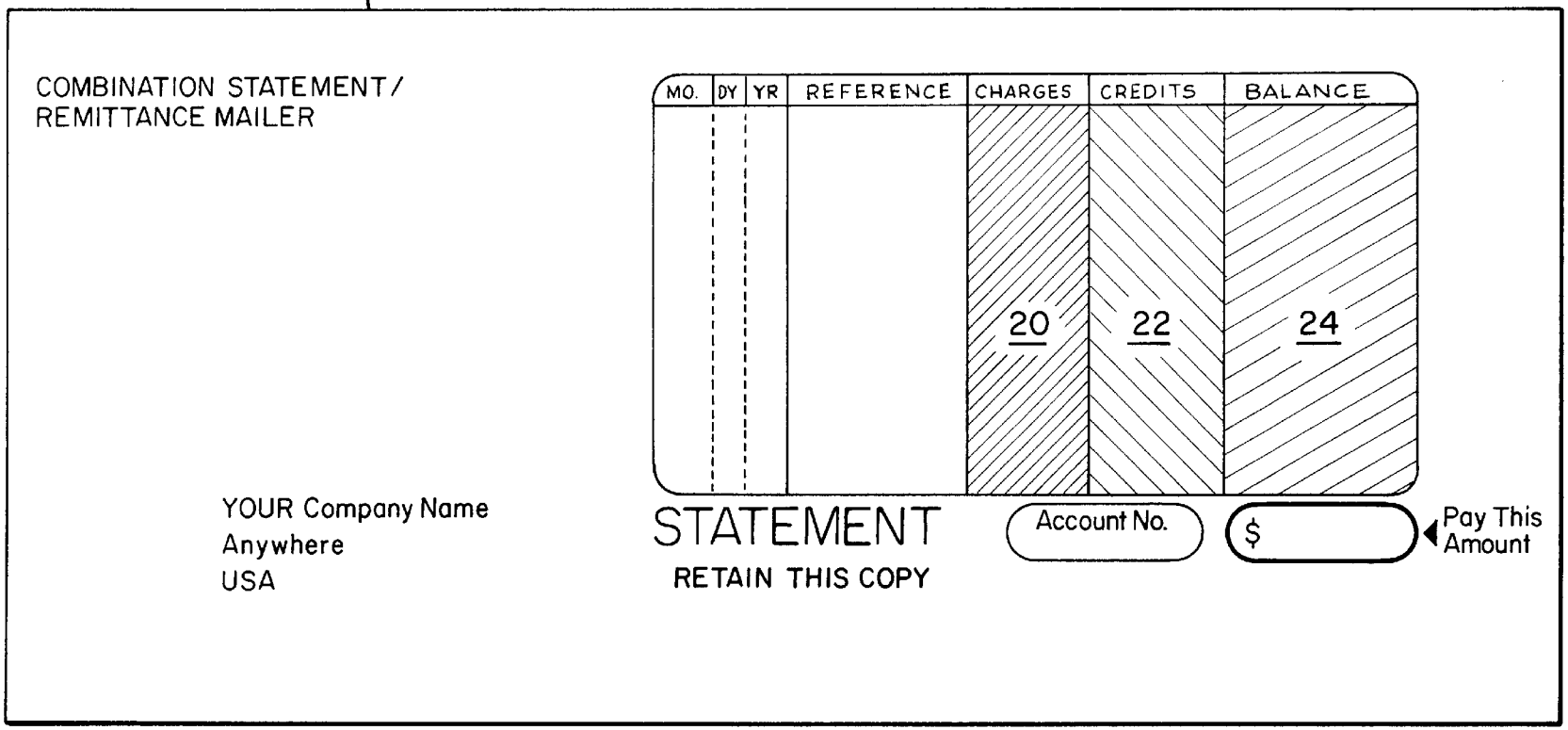
FIG. 2 is a plan view of a business form in accordance with another embodiment of the invention.

FIG. 2 illustrates another embodiment of the invention in which a business record 18 includes columns 20, 22 and 24 which are color activatable areas. The first column 20 is coated with a color former and color developer which form a first color, the second column 22 is coated with a color former and color developer which form a second color, and the third column 24 is coated with a color former and color developer which form a third color. In this manner, different categories or types of information can be emphasized or delineated without having to use preprinted colored screened areas.

Figure 4:
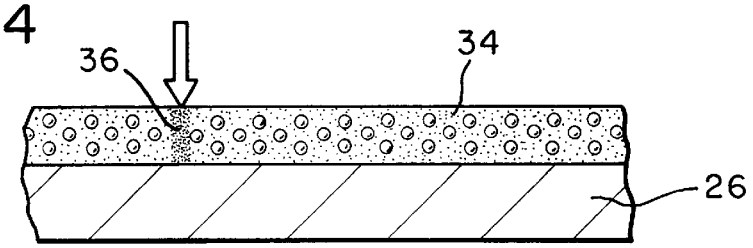
FIG. 4 is a fragmentary sectional view of a business form illustrating another embodiment of the present invention.
Figure 3:
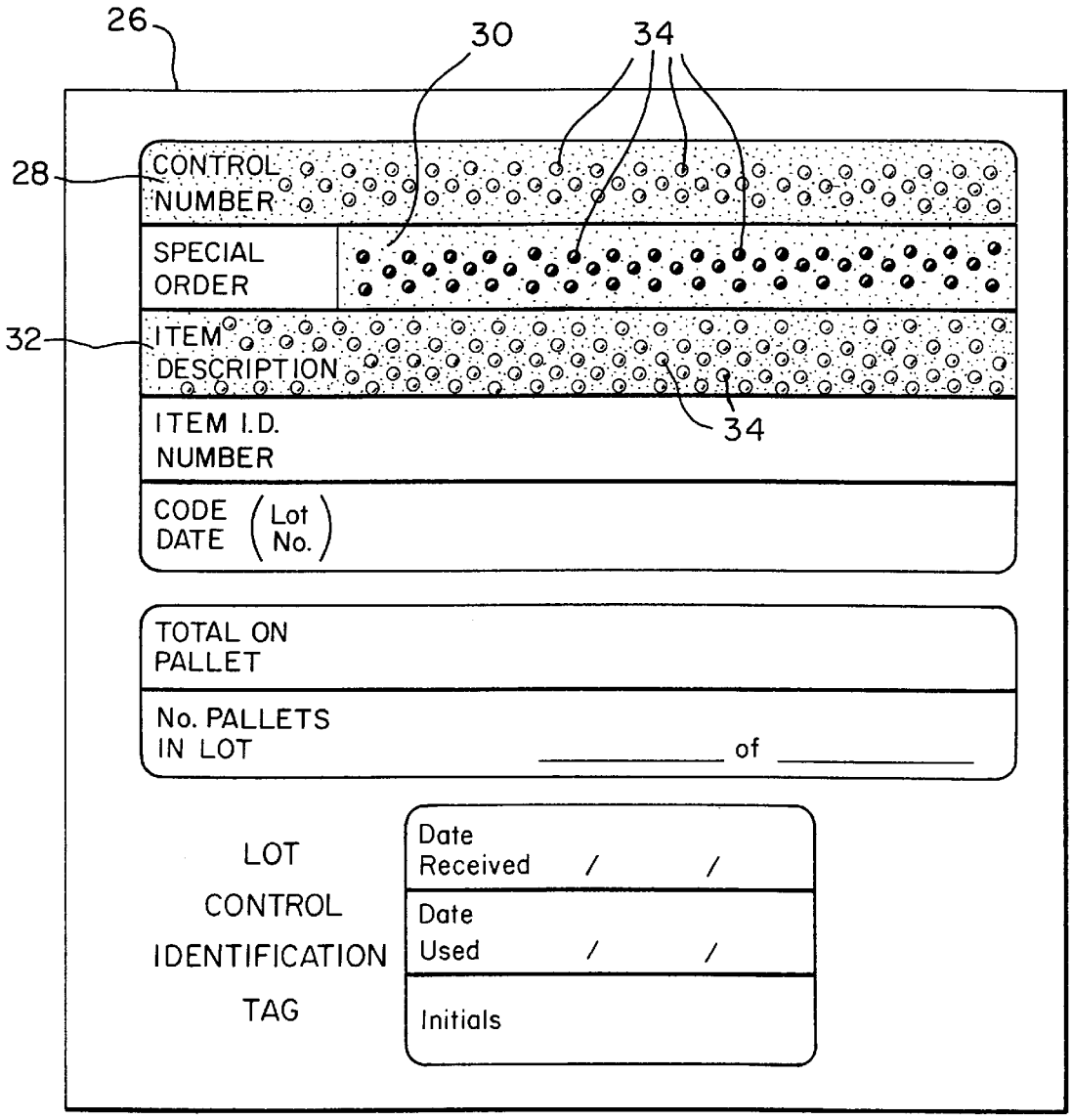
FIG. 3 is a plan view of a tag or label in accordance with another embodiment of the invention.

FIGS. 3 and 4 illustrate another embodiment of the invention in which a tag is provided having selected areas 28, 30 and 32 which may be activated to produce color upon the application of pressure. The tag 26 has been coated with self-contained coatings 34 comprising encapsulated color formers and color developers. As shown in FIG. 4, when an imaging force, indicated by the arrow, applies pressure to the surface of the document containing the self-contained coating 34, the color former and color developer combine to form a colored visible image 36 in the area beneath the imaging force. As shown in FIG. 3, area 28 is coated with a self contained coating which forms a first color, area 30 is coated with a self-contained coating which forms a second color, and area 32 is coated with a self-contained coating which forms a third color.

Alternatively, the coatings 34 may comprise solvent-containing microcapsules and solvent soluble colored dye particles. When the capsules are ruptured by an imaging force, the dye particles are dissolved by the released solvent and form a color. Such self-contained coatings usually exhibit a light colored tint before imaging. After the solvent-containing microcapsules are ruptured, more intense color is formed as dye particles are dissolved by the released solvent.

Figure 5:
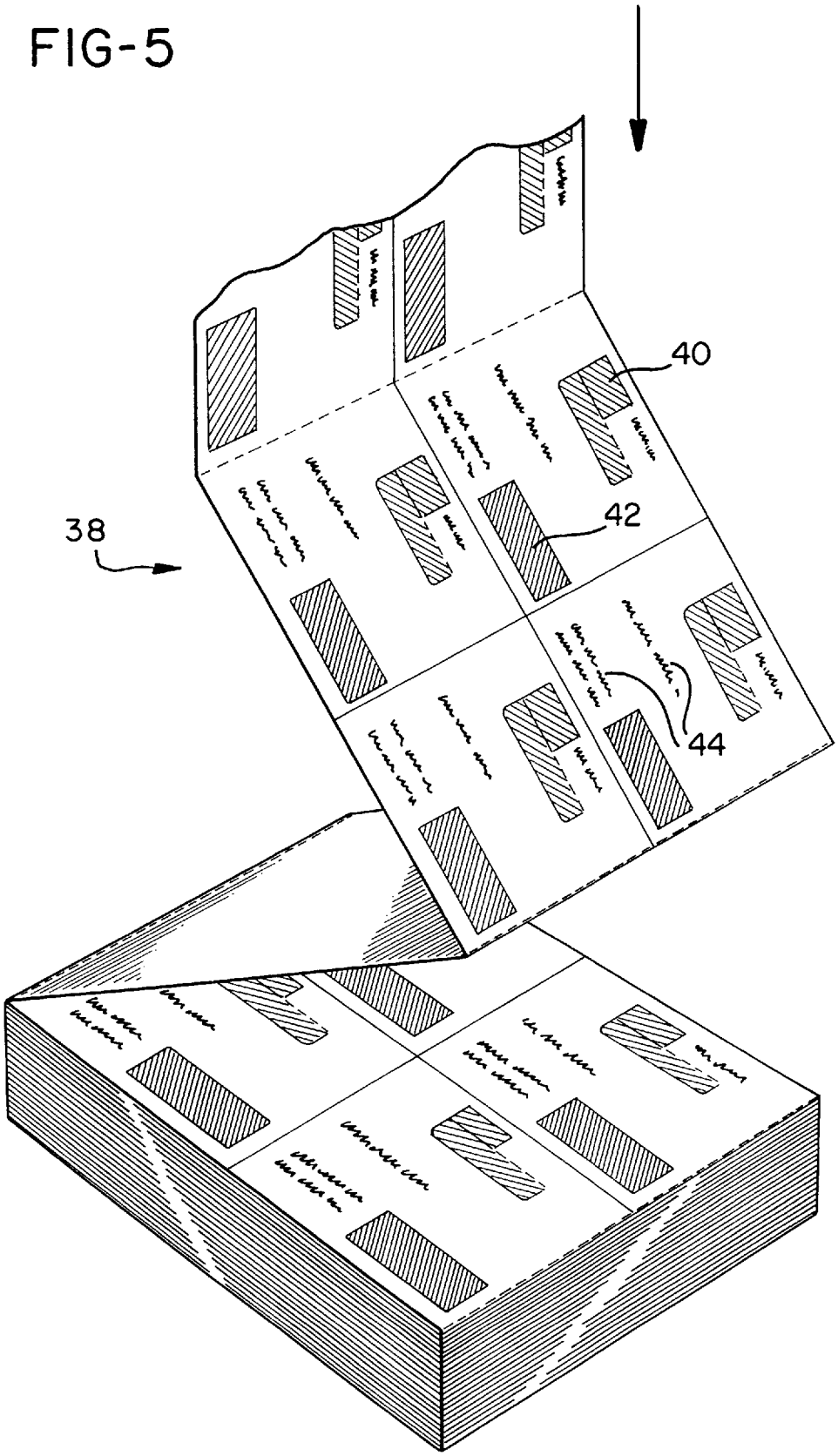
FIG. 5 is a perspective view of a continuous web of labels in accordance with the present invention.

In another embodiment of the invention illustrated in FIG. 5, a continuous form 38 is shown which contains a series of labels which are coated in selected areas to create different colored areas when printed with a thermal printer. If desired, the web may be preprinted with nonvariable, repetitive information by automated equipment and then coated in accordance with the present invention so that variable information may be printed in the color activatable areas. For example, as shown in FIG. 5, areas 44 contain preprinted information, area 40 is coated with a color former and color developer which forms a first color, and area 42 is coated with a color former and color developer which form a second color. Alternatively, the entire surface of the continuous form may be coated with self-contained coatings and printed using an impact printing device.

The invention provides the advantage that one form may be printed with several different activatable color combinations instead of using multi-ply labels or forms which require a different color for each ply. In addition, the invention provides a means of emphasizing or designating different categories of information on a form without having to use preprinted colored screened areas which require separate printing stations. As the coatings are initially colorless, the entire record, form, label, or tag may be initially white, and only the information and colors required for that particular form can be activated. This permits the user to print color customized records as needed. Further, the invention has the advantage that both information and the colored areas on the document may be achieved by printing in a single pass through a thermal or impact printer.

Other uses for the present invention include airline tickets or event tickets. For example, different colors could be activated on an airline ticket to designate first class or coach seating. The invention could also be used for shipping labels in which different colors are activated to designate the method or location of shipment. Other potential uses for the present invention will be apparent to those skilled in the art.

In order that the invention may be more readily understood, reference is made to the following example which is intended to illustrate the invention, but not limit the scope thereof.

Example 1

The following materials were combined to produce a preferred coating formulation:

| | Weight % |
|---|---|
| Color former[1] | 11.5 |
| Color developer[2] | 12.0 |
| Sensitizer[3] | 7.5 |
| Binder[4] | 3.5 |
| Water | 46.5 |
| Pigment[5] | 20.0 |

[1]OBD-2 from Nagase America Corporation
[2]Bisphenol A from Nagase America Corporation
[3]m-Terphenyl from Nagase America Corporation
[4]Polyvinyl alcohol from Air Products Company
[5]Calcium carbonate from J.M. Huber Company While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An imagable business record in which different selected areas may be activated to form colored areas comprising:

a substrate having first and second major surfaces, at least one surface of said substrate including on selected areas thereof a plurality of initially colorless coatings which, when activated, form a plurality of different colored visible areas on said substrate, wherein said business record is in the form of a continuous web for producing a series of imagable business records.

2. An imagable business record in which different selected areas may be activated to form colored areas comprising:

a substrate having first and second major surfaces, at least one surface of said substrate including on selected areas thereof a plurality of initially colorless coatings which, when activated, form a plurality of different colored visible areas on said substrate; wherein said initially colorless coatings comprise self-contained coatings of color formers and color developers in which either said color formers or said color developers are contained in pressure rupturable microcapsules;

and wherein said business record is in the form of a continuous web for producing a series of imagable business records.

* * * * *